United States Patent [19]

Schumaker et al.

[11] Patent Number: 4,797,798

[45] Date of Patent: Jan. 10, 1989

[54] MEDICAL EXAMINING LAMP

[75] Inventors: Eugene J. Schumaker, Milwaukee; Christopher J. Klug, West Allis, both of Wis.

[73] Assignee: Adjustable Fixture Co., Milwaukee, Wis.

[21] Appl. No.: 36,923

[22] Filed: Apr. 10, 1987

[51] Int. Cl.[4] ..... F21S 1/12

[52] U.S. Cl. ..... 362/413; 362/414; 362/431; 248/332; 248/161

[58] Field of Search ..... 362/413, 418, 431, 410, 362/414, 285, 382, 288; 248/333, 337, 161, 295.1

[56] References Cited

U.S. PATENT DOCUMENTS

| | | | |
|---|---|---|---|
| 2,073,754 | 3/1937 | Ozlek | 362/413 |
| 2,299,283 | 10/1942 | Curtis | 362/413 |
| 2,642,246 | 6/1953 | Stephans | 362/413 |
| 2,902,592 | 9/1959 | Cole et al. | 362/413 |
| 3,012,801 | 12/1961 | Cole | 362/413 |
| 3,955,079 | 5/1976 | Chapman et al. | 362/413 |

FOREIGN PATENT DOCUMENTS

| | | | |
|---|---|---|---|
| 24828 | of 1899 | United Kingdom | 248/333 |
| 417148 | of 1934 | United Kingdom | 248/161 |
| 681649 | 9/1939 | Fed. Rep. of Germany | 362/413 |
| 122549 | 8/1948 | Sweden | 362/413 |

*Primary Examiner*—Ira S. Lazarus
*Assistant Examiner*—D. M. Cox
*Attorney, Agent, or Firm*—Fred Wiviott

[57] ABSTRACT

A medical examining lamp includes a first tubular standard mounted on a base and extending upwardly therefrom and a second tubular standard telescopingly received within the first standard and having a lamp socket mounted at its upper end. A spring assembly is mounted on the lower end of the second standard and includes first and second leaf springs mounted in and diverging outwardly from one end of the second standard. The leaf springs are retained in position by deforming the end of the second standard inwardly into engagement therewith. An arcuate tip is formed on the outer end of each leaf spring for resilienly engaging the inner surface of the first standard.

5 Claims, 1 Drawing Sheet

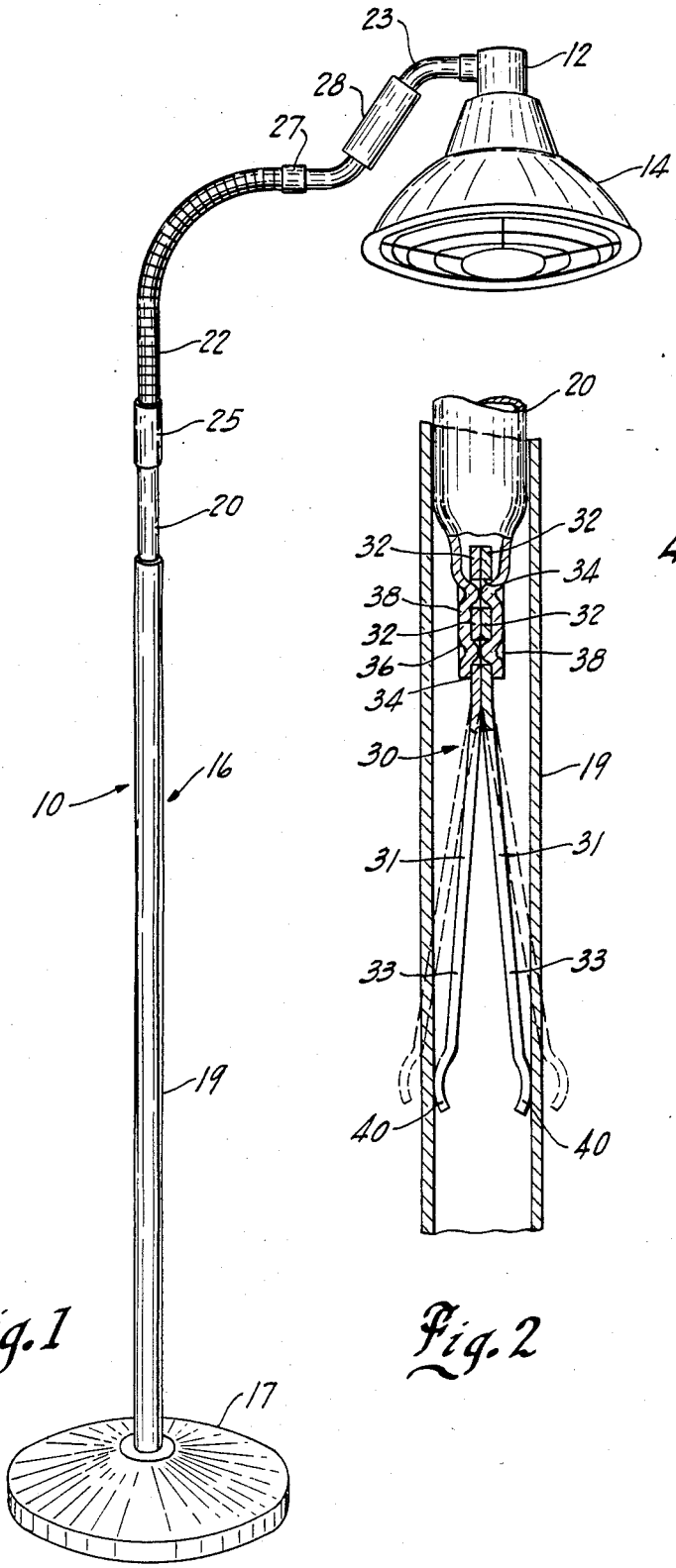
Fig.1
Fig.2
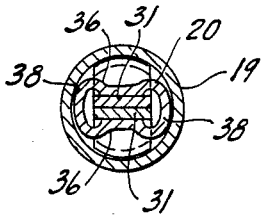
Fig.4
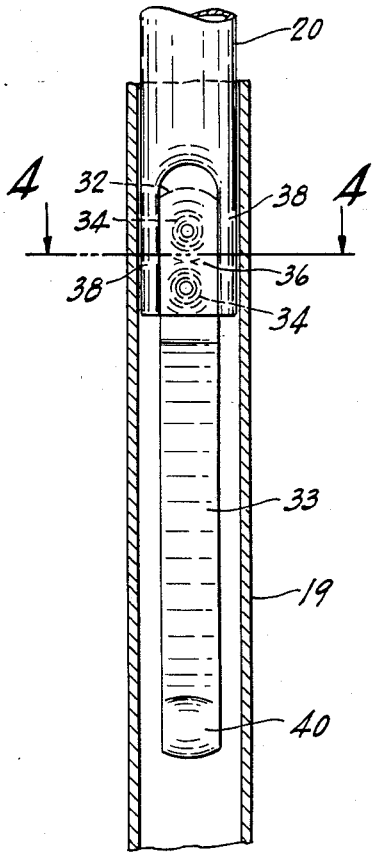
Fig.3

MEDICAL EXAMINING LAMP

BACKGROUND OF THE INVENTION

This invention relates to lamps and more particularly to adjustable medical examining lamps.

When used in medical examinations, it is desirable that lamps be adjustable with respect to height and angle of orientation and that it be possible to make such adjustments with one hand. Toward this end, one type of prior art medical examining lamp includes a pair of tubular standards having telescopingly engaging ends which permits vertical and rotary adjustment. A spring assembly is provided to retain the lamp in its adjusted positions and includes a pair of V-shaped wire spring members fixed by an adapter within the end of one of the standards. Each spring member diverged outwardly from the adapter for engaging the inner surface of the other standard. While such prior art spring assemblies are effective to hold the lamp in its adjusted position, it is not wholly satisfactory because the ends of the springs tend to catch on the welding seams of the outer standard as the lamp is rotated. This results in uneven movement and caused an annoying clicking sound as the spring ends catch on and then snap past the seam.

A second type of prior art spring assembly for medical examining lamps employs a generally U-shaped spring mounted on the end of a cylindrical plug by means of a tubular spacer, an axial coil spring and a bolt, nuts and washers. The plug is rotatably received within the inner standard and the legs of the spring are received within the outer standard for resiliently engaging its inner surface. During operation, the springs slide longitudinally within the outer standard but remain fixed relative thereto upon rotation as the plug rotates within the inner standard. While this prior art lamp assembly eliminates the clicking problem, the spring assembly requires several costly parts such as the plug, the tubular spacer and the coil spring in addition to a bolt, washers and nuts. Furthermore, the U-shaped spring of such prior art assemblies is formed by a bending operation so that the spring force tends to be non-uniform as between different springs.

SUMMARY OF THE INVENTION

It is an object of the invention to provide a new and improved resilient mounting assembly for adjustable medical examining lamps.

A further object of the invention is to provide medical examining lamp having a resilient mounting assembly which does not cause annoying clicking sounds during rotation.

Another object of the invention is to provide a medical examining lamp which is relatively inexpensive and easy to assemble.

These and other objects and advantages of the instant invention will become more apparent from the detailed description thereof taken with the accompanying drawings.

In general terms the invention comprises a lamp which includes a first tubular member and a second tubular member telescopingly received within the first member, a lamp socket coupled to the opposite end of one of one member and the opposite end of the other member being secured to a support. A spring assembly is mounted by a retainer at the telescoped end of the second tubular member and includes a plurality of leaf springs mounted in and diverging outwardly from the end of the second tubular member, for resiliently engaging the inner surface of the first tubular member to permit axial and rotational relative movement of the tubular members but retaining the tubular members in their adjusted positions.

BRIEF DESCRIPTION OF THE DRAWINGS

FIG. 1 is a view showing a medical examining lamp in which the mounting assembly of the invention is incorporated;

FIG. 2 is a fragmentary view, with parts broken away, of the mounting assembly according to invention;

FIG. 3 is a side view of the mounting assembly shown in FIG. 2; and

FIG. 4 is a view taken along lines 4—4 of FIG. 3.

DETAILED DESCRIPTION OF THE PREFERRED EMBODIMENT

A medical examining lamp 10 is shown in FIG. 1 to include a lamp socket 12 and a shade 14 mounted at the upper end of a standard 16. The lower end of the standard is received in a heavy circular base 17 which supports and provides stability to the lamp 10.

The standard 16 is shown to include four sections which comprise first and second relatively rigid tubular members 19 and 20, a flexible tubular member 22 and an angular neck member 23. The first tubular member 19 is secured at its lower end to a center opening in base 17 and extends vertically upwardly therefrom where its upper end telescopingly receives the second tubular member 20. The flexible tubular member 22 is secured by a suitable coupling 25 to the upper end of tubular member 20 and a second suitable coupling 27 at its opposite end is connected to the neck member 23. Mounted intermediate the ends of the neck member 23 is a hand grip 28 while the lamp socket 12 and the shade 14 are secured to the remote end of the neck member.

As seen in FIGS. 2 and 3, the tubular member 20 is telescopingly received within the tubular member 19 and has a spring assembly 30 at its lower end. The spring assembly 30 comprises a pair of identical leaf springs 31 which are bent intermediate their ends to define upper portions 32 which are mounted in back-to-back engagement and outwardly extending divergent lower leg portions 33. Each upper portion 32 has a pair of holes 34 which are aligned with those of the other. While the spring assembly 30 may be secured in the end of tube 20 in any suitable manner, in the preferred embodiment, the end of tube 20 is deformed around the spring portions 32 so that the springs 31 are retained. In particular, the opposite sides 36 are deformed inwardly so that they assume a generally planar configuration and engage the sides of the upper spring portions 32 and with the metal pressed into the holes 34 within each of the spring members 31. In this manner the springs 31 are firmly anchored in the end of tubular member 20. In the forming process, the portions 38 of the tubular member 20 which are at 90° C. from the planar portions 36 are maintained in a die so that they do not bulge outwardly to exceed the diameter of tubular member 20. This insures that the end of the tube member 20 will be received within the tube member 19. Formed at the end of each of the springs 31 is a contact 40 which preferably defines a spherical section.

When the springs 33 are unflexed, the contacts 40 are spaced apart a distance greater than the internal diameter of tube member 19 as shown by broken lines in FIG.

2. In assembly, the lower portions of spring 31 are forced together so that the springs and the tube 19 may be received within tube 20. The spring 31 then flex outwardly so that the contacts 40 resiliently engage the inner surface of tube 19.

In order to elevate the socket 12 and shade 14 relative to the base 17, it is merely necessary to grip the tube member 20 or the handle 28 and move the assembly vertically relative to tubular member 19. The high pressure engagement between the spring contacts 40 and tube 19 is sufficient to retain the tube 20 in its adjusted position. Similarly, rotation of the lamp socket 12 and shade 14 can be accomplished by the application of a tangential force. This causes the tube 20 to rotate within the tube 19 as the contacts 40 slide across its inner surface. Because of their curved configuration, contacts 40 slide easily over any welding seams within tube 19. In addition, because of the flat configuration of the springs they are relatively inflexible in the tangential direction further minimizing any tendency to catch and then release from the welding seams so that the snapping sound of prior art devices is further minimized.

While only a single embodiment of the invention has been illustrated and described, it is not intended to be limited thereby but only by the scope of the appended claims.

We claim:

1. A lamp includes a first tubular member and a second tubular member telescopingly received within the first member, a lamp socket coupled to the opposite end of one of said members and the opposite end of the other member being secured to a support, a spring assembly mounted at the telescoped end of the second tubular member and including a pair of leaf springs having an end portion disposed within the second tubular member, said leaf springs diverging outwardly from the end of the second tubular member, at least one opening formed in the end portions of said leaf springs, and retaining means extending into said openings for retaining the leaf springs in said second tubular member, said leaf springs resiliently engaging the inner surface of the first tubular member to permit axial and rotational relative movement of the tubular members but retaining the tubular members in their adjusted positions, said second tubular member being deformed inwardly for engaging the end portions of said leaf springs extending into said openings for clamping and retaining the leaf springs in the end of the second tubular member.

2. The lamp set forth in claim 1 wherein each of said leaf springs has an arcuate tip formed at its remote end for resiliently engaging the inner surface of the first tubular member and for resiliently sliding across the inner surface of the second tubular member and to minimize the possibility of catching on any obstructions therein.

3. A medical examining lamp including a base, a first tubular member extending generally vertically from said base, a second tubular member having one end telescopingly received within one end of the first member, a lamp socket coupled to the opposite end of the first member, the opposite end of the second member being secured to a support, a spring assembly mounted at one end of the second tubular member and including first and second leaf springs mounted in and diverging outwardly from the end of the second tubular member, each of said leaf springs having an end portion disposed within one end of the second tubular member, at least one opening formed in each of the end portions, and retaining means extending into said openings for retaining the leaf springs in the second tubular member, said leaf springs resiliently engaging the inner surface of the first tubular member to permit axial and rotational relative movement of the tubular members but retaining the tubular members in their adjusted position, said second tubular member being deformed inwardly for engaging the end portion of said leaf springs and extending into said openings for clamping and retaining the leaf springs in the end of the second tubular member.

4. The lamp set forth in claim 3 wherein each of said leaf springs has an arcuate tip formed at its remote end for resiliently engaging the inner surface of the first tubular member and resiliently sliding across the inner surface of the first tubular member to minimize the possibility of catching on any obstructions therein.

5. The lamp set forth in claim 3 wherein each of said leaf springs has a tip which is bidirectionally curved and formed at its remote end for resilintly engaging the inner surface of the first tubular member and for resilintly sliding across the inner surface of the second tubular member and to minimize the possibility of catching on an obstruction therein.

* * * * *